United States Patent [19]

DeWoolfson et al.

[11] Patent Number: 4,469,212

[45] Date of Patent: Sep. 4, 1984

[54] CONTAINER COLLECTION APPARATUS WITH PISTON-ACTUATED CRUSHER

[75] Inventors: Bruce H. DeWoolfson, Arlington, Va.; Stanley Flowers, W. Milton; Robert F. Freund, Centerville, both of Ohio

[73] Assignee: Environmental Products Corporation, Arlington, Va.

[21] Appl. No.: 370,241

[22] Filed: Apr. 20, 1982

[51] Int. Cl.[3] ..... G07F 7/06

[52] U.S. Cl. ..... 194/4 C; 100/53

[58] Field of Search ..... 194/4 C, 4 R; 100/902, 100/53; 209/567

[56] References Cited

U.S. PATENT DOCUMENTS

| | | |
|---|---|---|
| Re. 27,643 | 5/1973 | Myers . |
| 2,228,294 | 1/1941 | Wurzbach . |
| 2,558,255 | 6/1951 | Johnson et al. . |
| 2,943,306 | 6/1960 | Gray et al. . |
| 2,968,235 | 1/1961 | Marica . |
| 3,011,036 | 11/1961 | La Rocco . |
| 3,015,376 | 1/1962 | Glembring . |
| 3,066,600 | 12/1962 | Couty et al. . |
| 3,191,609 | 6/1965 | Gauselmann et al. . |
| 3,467,855 | 9/1969 | Rance . |
| 3,489,354 | 2/1969 | Harper et al. . |
| 3,492,564 | 1/1970 | Baker, Jr. . |
| 3,776,128 | 12/1973 | Morris . |
| 3,792,765 | 2/1973 | Arp . |
| 3,828,242 | 8/1974 | Vann . |
| 3,857,334 | 12/1974 | Arp . |
| 3,875,498 | 4/1975 | Mahan et al. . |
| 3,907,087 | 9/1975 | Tanaka . |
| 3,961,238 | 6/1976 | Randolph, Jr. . |
| 3,996,510 | 12/1976 | Guichard . |
| 4,010,766 | 3/1977 | Bowles et al. . |
| 4,091,725 | 5/1978 | Arp . |
| 4,130,792 | 12/1978 | Sullivan . |
| 4,138,709 | 2/1979 | Colwill . |
| 4,141,493 | 2/1979 | Arp . |
| 4,241,821 | 12/1980 | Wu et al. . |
| 4,245,731 | 1/1981 | Herbst et al. . |
| 4,248,334 | 2/1981 | Hanley et al. . |
| 4,316,533 | 2/1982 | Hughes . |
| 4,324,325 | 4/1982 | DeWoolfson . |
| 4,345,679 | 8/1982 | DeWoolfson ..... 194/4 C |

FOREIGN PATENT DOCUMENTS

| | | |
|---|---|---|
| 354258 | 7/1905 | France . |
| 52-8683 | 1/1977 | Japan . |
| 286301 | 2/1928 | United Kingdom . |

OTHER PUBLICATIONS

Arp, U.S. Patent Application Ser. No. 612,088 filed 9/10/1975 (Abandoned).

Arp, U.S. Patent Application Ser. No. 742,662 filed 11/17/1976 (Abandoned).

C. J. Leftanlt, Jr., "Reversed Vending Machine Encourages Aluminum Conservation", Machine Design, vol. 53, No. 16, Jul. 9, 1981.

*Primary Examiner*—Stanley H. Tollberg

*Attorney, Agent, or Firm*—Finnegan, Henderson, Farabow, Garrett & Dunner

[57] ABSTRACT

Apparatus for collection of aluminum containers and for dispensing payment therefor, including an exterior housing having an access port therein; a container access area sized to accommodate both crushed and non-crushed containers; an aluminum detector for determining whether a container offered by a customer is substantially aluminum, independent of the configuration of the container; a movable shelf responsive to the aluminum detector for accepting a container identified by the aluminum detector as being substantially aluminum; coin-dispensing structure for dispensing payment for containers accepted; a piston-actuated crusher for crushing the containers, the shelf being horizontally mounted on the piston; and a bag for storing the crushed containers.

6 Claims, 7 Drawing Figures

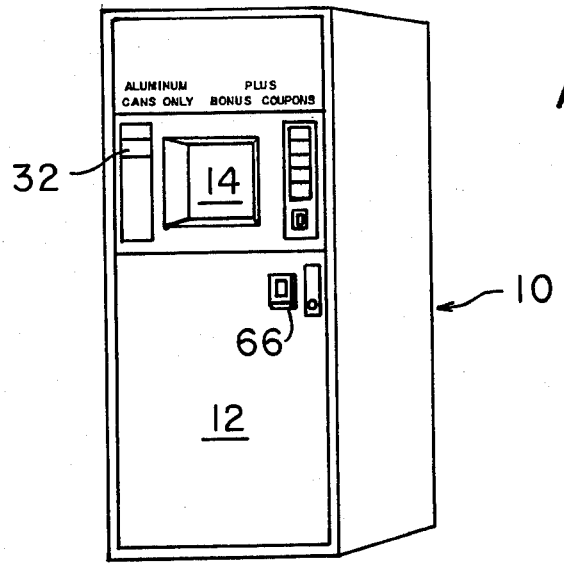
FIG. 1
FIG. 2
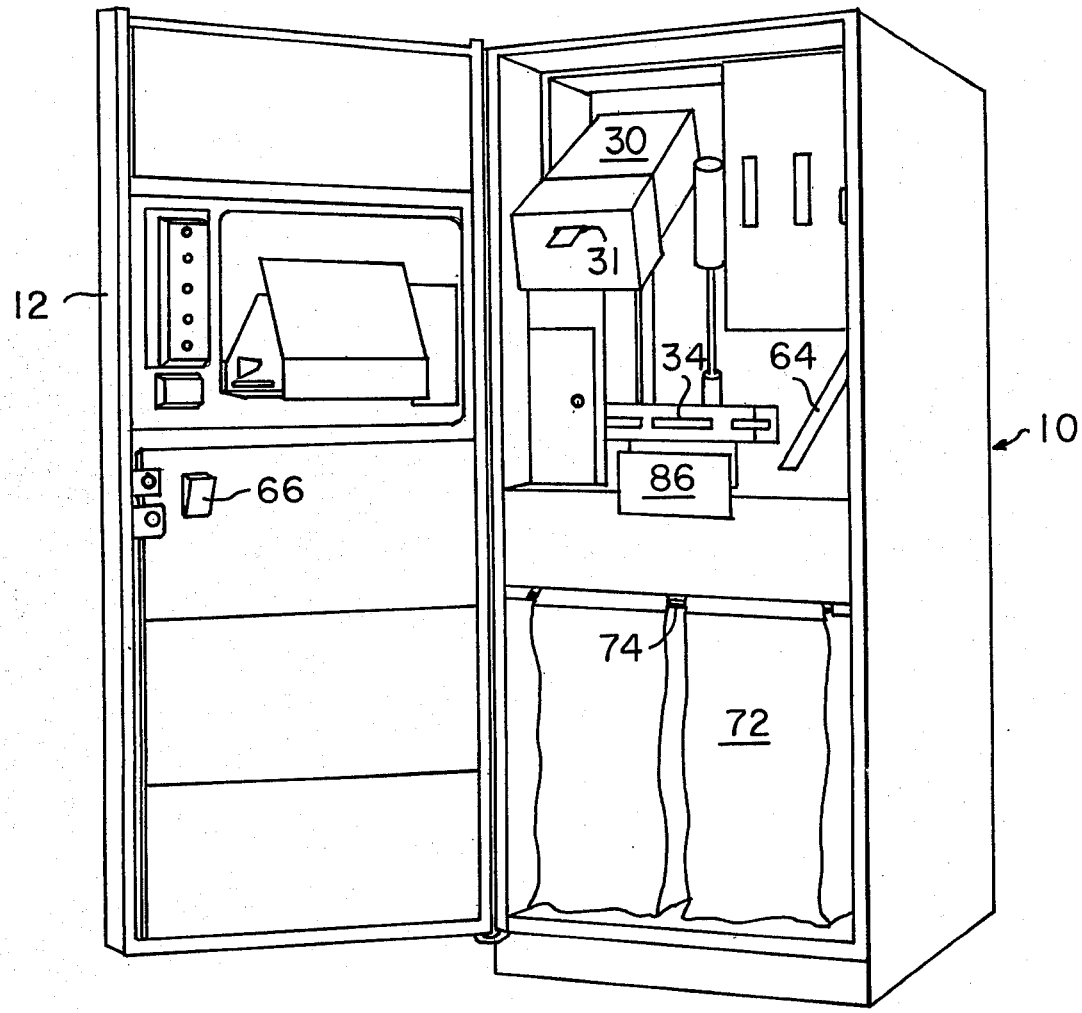

CONTAINER COLLECTION APPARATUS WITH PISTON-ACTUATED CRUSHER

RELATED APPLICATION

This application is related to commonly assigned U.S. patent application Ser. No. 355,206, filed Mar. 5, 1982 now U.S. Pat. No. 4,440,284, entitled "Automated Aluminum Can Redemption Center For Direct Return Deposit Payout."

BACKGROUND OF THE INVENTION

This invention relates to apparatus for collecting and storing used metallic containers and, more particularly, machines for collecting, crushing and storing used aluminum beverage cans and for dispensing coins or tokens in exchange for beverage cans so collected.

With the increasing emphasis in recent years on energy conservation, the recycling of metallic containers such as beverage cans has become an important factor in the conservation effort. More specifically, the recycling of aluminum cans has proven to be remarkably efficient in energy saving. Yet only a fraction of the total annual production of aluminum beverage cans is recovered after use, with the remainder being discarded often as litter.

Several machines have been developed in the prior art for encouraging the recovery and recycling of metallic containers. For example, U.S. Pat. Nos. 3,857,334 and 3,907,087 disclose apparatus for crushing metallic containers and discharging refund coins or tokens in exchange therefor. U.S. Pat. No. Re. 27,643 describes a process and apparatus for collection of metal containers in which tokens are automatically dispensed for the containers collected. In general, the prior art machines induct any type of inserted container, and then utilize some type of sensing means for differentiating between those containers for which a token is to be dispensed and those containers for which no payment is to be made. For example, Arp, U.S. Pat. No. 3,857,334, includes control means for issuing a token only when cans of a given size, weight and design are crushed in the machine. Myers, U.S. Pat. No. Re. 27,643, discloses a mechanism which utilizes a plurality of bar magnets for separating cans formed of magnetic material from non-magnetic cans.

Several of the prior art apparatus are designed to take advantage of the shape of the container in feeding the metallic containers into the apparatus. This type of feeding mechanism has an inherent drawback in that the containers must be sufficiently close to their original shape to roll down an inclined surface. As a result, a large majority of containers which have been totally or partially crushed by the user, cannot be fed into such machines efficiently. In addition, the sensing or differentiating mechanisms of the prior art machines do not appear to be adaptable to operation on partially or fully crushed containers of different sizes.

Prior art machines utilize a variety of different mechanisms for crushing the collected containers. In general, these mechanisms utilize a large number of moving parts, or require a large crushing member such as that shown in Hanley et al., U.S. Pat. No. 4,248,334.

Accordingly, it is a primary object of this invention to provide an improved container collection apparatus which is capable of readily accepting containers in their originally manufactured shape, or containers which have been manually deformed by consumers, and which efficiently accept and crush containers in one simple mechanical operation.

It is a further object of this invention to provide a container collection machine with a sensing mechanism which can readily detect the presence of aluminum containers of varying sizes, can do so prior to accepting the inserted container into the interior of the machine, and can also crush the container in one simple mechanical motion.

Another object of the invention is to provide an improved container collection apparatus with a mechanism for detecting the presence of aluminum containers which are not substantially empty, and for allowing those containers to bypass the crushing operation.

Additional objects and advantages of the invention will be set forth in part in the description which follows and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects and in accordance with the purpose of the invention, as embodied and broadly described herein, the machine of this invention comprises preselection means for exposing a crushed or non-crushed container offered by a customer to an electromagnetic field for identifying whether the container is substantially aluminum. The preselection means includes a container access area configured to accommodate both crushed and non-crushed containers for exposure to the field. The apparatus also includes means for accepting only a container identified by the preselection means as being substantially aluminum, independent of the configuration of the container; coin-dispensing means responsive to the preselection means for dispensing coins in return for containers having a substantially aluminum composition; means responsive to the accepting means for crushing the accepted containers, the crushing means including an anvil and a horizontally movable piston cooperating with the anvil for crushing a container between the anvil and the piston; and means for storing crushed containers received from the crushing means.

Preferably, the anvil is movably mounted in the machine under a bias for resiliently absorbing impact when the container is crushed between the anvil and the piston.

The accepting means preferably includes a horizontal shelf fixed to the piston for supporting the container in the container access area, and for allowing the container to fall by gravity into the path of the piston and the anvil when the piston is activated.

The machine also preferably includes weight override means for ordinarily supporting the container in the path of the anvil and the piston, the override means allowing the container to fall into the storage means when the container exceeds a predetermined weight.

BRIEF DESCRIPTION OF THE DRAWINGS

The accompanying drawings which are incorporated in and constitute a part of the specification, illustrate one embodiment of the invention, and together with the description, serve to explain the principles of the invention. Of the drawings:

FIG. 1 is perspective view of the exterior of the apparatus;

FIG. 2 is a front view of the interior portion of the apparatus and the rear of the front door;

DESCRIPTION OF THE PREFERRED EMBODIMENT

Reference will now be made in detail to the present preferred embodiment, an example of which is illustrated in the accompanying drawing. Referring now to FIGS. 1 and 2, it may be seen that the container-collecting apparatus provides a rapid and efficient means for collecting containers for recycling, and effecting direct payment of return deposits. The apparatus for collecting of containers generally includes a rectangular cabinet housing 10 having a front wall 12 which is hinged to allow access to the interior of the housing 10 for maintenance of the operating components and to allow for removal of the containers collected in the apparatus.

Figure 4:
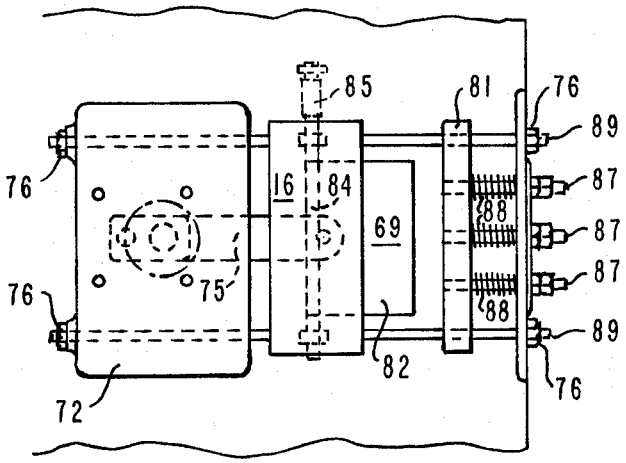
FIG. 4 is a top view of the crushing mechanism of the invention with the piston in the open position.
Figure 5:
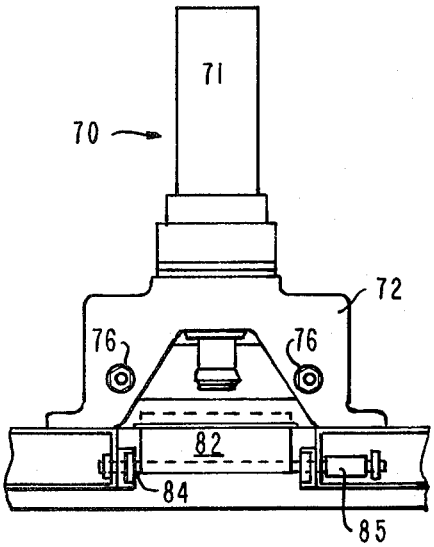
FIG. 5 is a rear view of the crushing mechanism of the apparatus.
Figure 3:
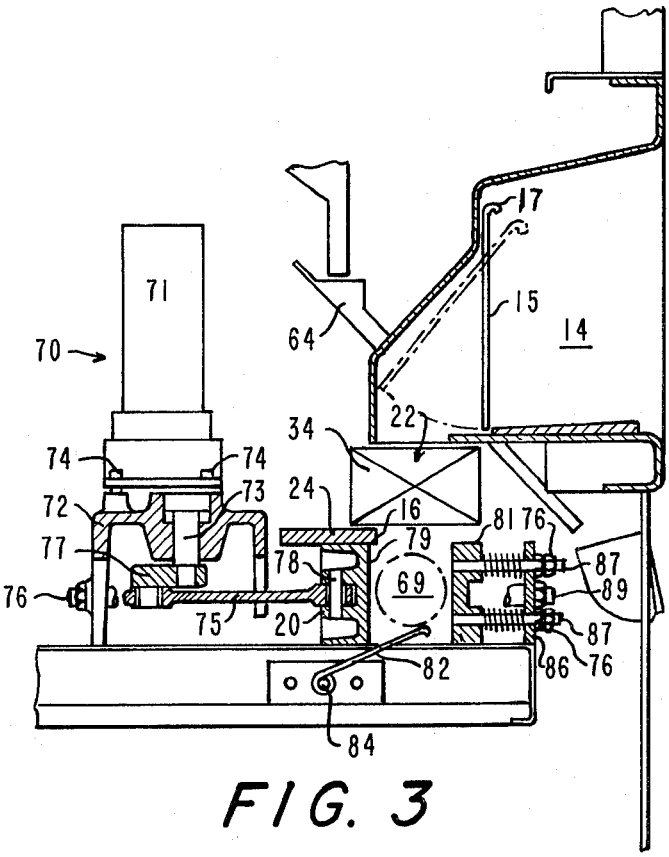
FIG. 3 is a right side cutaway view of the access and crushing portions of the apparatus.

In accordance with the invention, the apparatus includes preselection means for exposing a crushed or non-crushed container offered by a customer to an electromagnetic field for identifying whether the container is substantially aluminum without direct physical contact with the container. The preselection means includes a container access area configured to accommodate both crushed and non-crushed containers for exposure to the field. As embodied herein and as shown in FIG. 3, the preselection means includes an access port 14 in the front wall 12 of the housing 10. A door 15 covers the access port 14, and the door 15 may be provided with an electronic locking mechanism (not shown) which prevents operation of the apparatus when the door 15 is unlocked. The door 15 may also include means for automatically opening the door upon unlocking (not shown), such as a spring. The door 15 also preferably includes a lip 17 for facilitating the opening of the door to remove a non-acceptable container from the container access area 22. In accordance with the invention, the apparatus also includes means for accepting only a container identified by the preselection means as being substantially aluminum, independent of the configuration of the container.

Preferably, the accepting means includes means for depositing the container by gravity into a crushing means. As herein embodied, the accepting means includes a shelf 16 forming a horizontal plane on the top edge 18 of a reciprocating piston member 20. The piston 20 forms the crushing mechanism in the apparatus, and will be described in more detail below. The shelf 16 forms the floor of the container access area 22 (also described hereinafter) when the crushing mechanism is not operating. Shelf 16 may be formed of any suitable material, and is attached to piston 20 by means of screws 24. When a container is inserted into the container access area 22, the container rests directly on shelf 16. During operation of the machine the piston 20 retracts from under container access area 22, thereby moving shelf 16 out of its position and allowing the container to drop by gravity into the crushing mechanism.

Preferably, the preselection means includes aluminum detection means, the container being disposed adjacent the aluminum detection means by a customer. As herein embodied and as best shown in FIGS. 2 and 3, the preselection means includes an aluminum detector 34 disposed in the walls of container access area 22. The aluminum detector 34 is mounted in the apparatus so that a container inserted through the access port 14 onto the shelf 16 will be disposed adjacent the detector 34. The aluminum detector means is preferably mounted on opposite sides of the container access area 22. However, other configurations and designs may be used. A preferred form for the aluminum detection means is disclosed in U.S. patent application Ser. No. 248,022, filed Mar. 26, 1981, of common assignee, which is incorporated herein by reference. Another form for the aluminum detection means is disclosed and claimed in commonly owned and allowed U.S. patent, application Ser. No. 148,371, filed May 9, 1980 now U.S. Pat. No. 4,345,679, which is also incorporated herein by reference.

In the illustrated embodiment, the preselection mechanism is actuated by a current from the apparatus power supply (not shown). When an acceptable container is determined to be present, the current through the sensing circuit is cut off and the crushing and dispensing means are actuated.

If a container having a composition other than desired is inserted into the container access area 22, and the preselection means is actuated, the identification circuitry will indicate that an undesired container is present, and the apparatus will not operate further to accept the container. Thus, only containers of aluminum will be received and crushed by the apparatus.

When the operation of the preselection means identifies the composition of the container as aluminum, the shelf 16 moves out of position by the action of piston 20, allowing the container to drop into the crushing area 26.

In accordance with the invention, the apparatus also includes coin-dispensing means responsive to the preselection means for dispensing payment in return for containers having a substantially aluminum composition.

Figure 6:
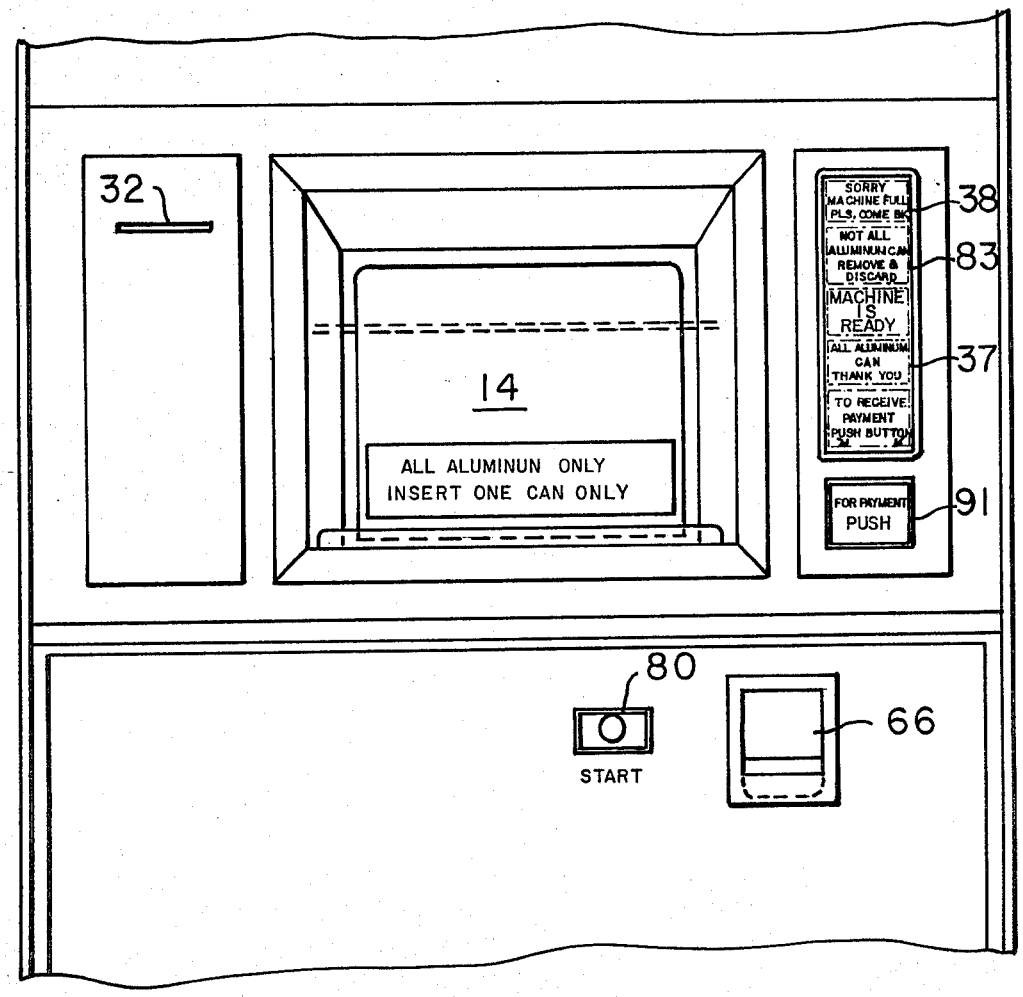
FIG. 6 is an enlarged front view showing the indicator panel and access port of the apparatus.
Figure 7:
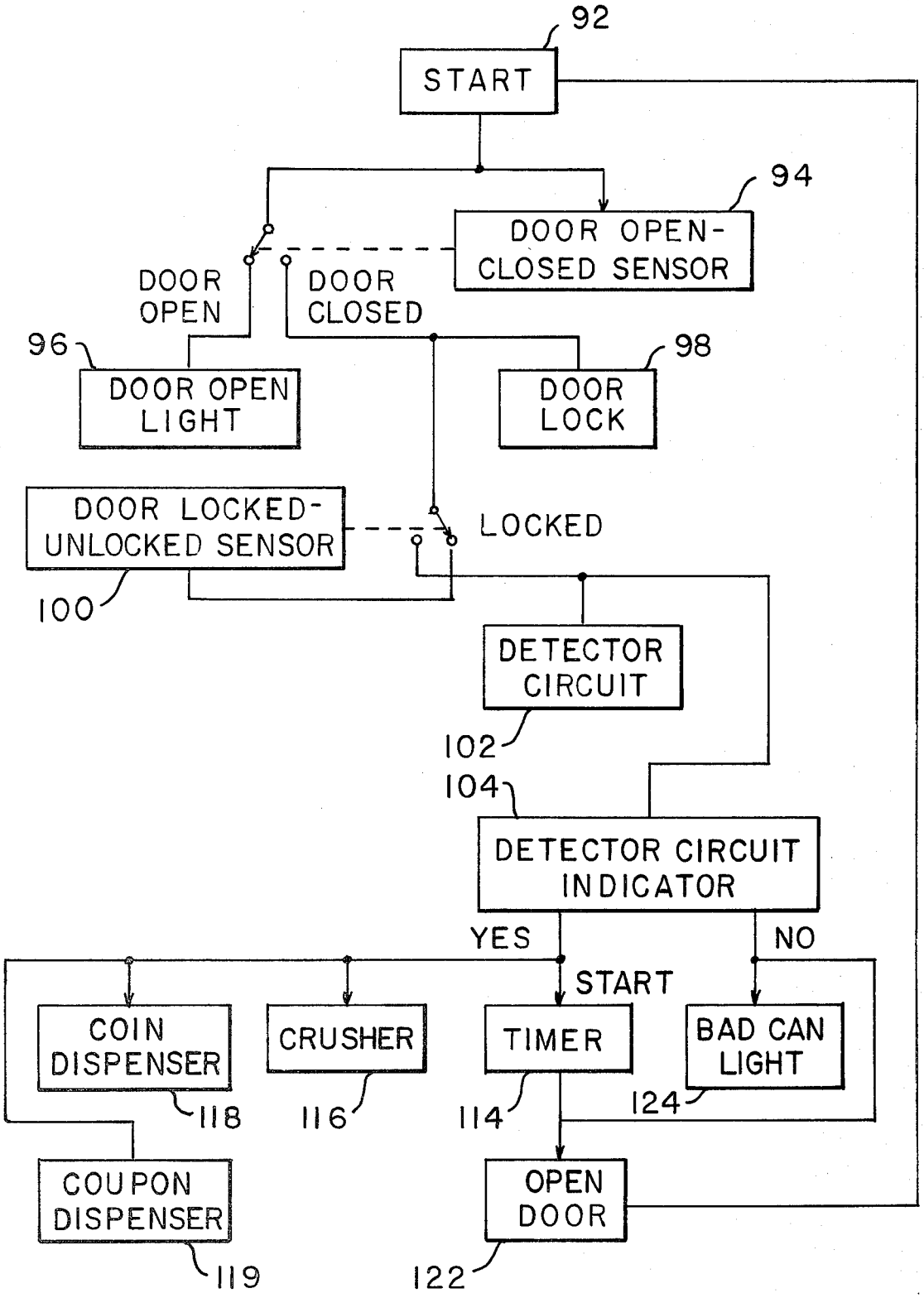
FIG. 7 is a block functional diagram of the electrical components of the apparatus.

As herein embodied and as shown in FIG. 2, a coin chute 64 is provided to channel individual coins or tokens to be dispensed to a slot 66 in the front wall 12 of the housing 10. The dispensing means is electrically connected to the preselection means by appropriate circuitry as generally shown in FIG. 7, and is responsive thereto. Thus, coins are dispensed in response to receipt of an aluminum container. Preferably, a counter (not shown) may be employed to calculate the payment due for multiple containers received. A coin magazine having coin sleeves for different sized coins may be used with the counter to allow a single refund of correct change in return for receipt of several containers. With this embodiment, a push-button 91 (FIG. 6) may be used to signal when the refund is to be paid.

The use of the interchangeable coin magazine allows for rapid servicing of the machine since a full coin magazine may be quickly interchanged with the empty or partially filled magazine in the machine.

The coin-dispensing means of the apparatus may also include suitable sensors (not shown) to indicate when the coin magazine is emptied and to actuate a signal light on the front of the apparatus.

Preferably, the invention also includes token-dispensing means for issuing coupons at predetermined or random intervals for containers collected. As herein embodied, the token dispensing means includes a dispenser 30 mounted within the housing 10, and electrically connected to the preselection means of the apparatus. Individual coupons are dispensed one at a time through a slot 31, which is aligned with an opening 32 in the door 12 of housing 10. Preferably, the structure of the token dispenser 30 is conventional, and accommodates rolls of coupons in the form of tickets. The token dispenser may be connected to a counter (not shown) in the coin-dispensing means for issuing a coupon only upon acceptance of a predetermined plurality of containers.

This token dispenser acts as an additional inducement for consumers to return containers, since the coupons or tickets may be exchangeable for valuable discounts or prizes.

In accordance with the invention, the apparatus also includes means responsive to the accepting means for crushing the containers. The crushing means includes an anvil and a horizontally movable piston cooperating with the anvil for crushing the container between the anvil and the piston. As herein embodied, the crushing means includes a horizontally reciprocating piston 20, mounted within the housing and aligned with a crushing area 69 which receives the individual containers by gravity.

A suitable driving mechanism 70 is operatively connected to the piston 20 for imparting the necessary reciprocal motion thereto. The driving mechanism includes an electric motor 71 which powers a rotating shaft 73. The motor 71 is mounted onto a supporting bracket 72 by means of bolts 74 or other appropriate fastening means. The shaft 73 is coupled to a piston rod 75 through an eccentric member 77. Rotation of the shaft 73 causes reciprocal motion of piston rod 75, thereby actuating piston 20. In operation, an accepted container falls into the crushing area 69 when the piston 20 is retracted and shelf 16 moves horizontally with piston 20. The container is supported in the crushing area 69 by a weight override support 82 (described in more detail below), which extends to approximately the middle longitudinal axis of the crushing area 69. The piston then cycles back, and the face plate 79 of piston 20 crushes the container against an anvil 81. The crushed container is flattened to a thickness which allows it to by-pass the support 82, thereby falling by gravity into the storage area of the machine. Either immediately after crushing, or on the next cycle of the piston 20 (if the piston 20 initially holds the container by friction against the anvil 81), the crushed container falls by gravity into the storage area of the machine.

In order to prevent the apparatus from crushing full or partially filled containers, the weight override support 82 is provided. When an accepted container drops into the crushing area 69, it is usually supported by the weight override support 82. The support 82 is rotatably connected to a shaft 84 and is biased into its normal can-supporting position by a spring 85 surrounding one end of shaft 84. The weight of a container causes a downward force on the support 82, and when that weight is greater than the biasing force of the spring 85, the support 82 opens, allowing the container to drop into the storage area in a non-crushed state. Thus, the interior of the apparatus is not soiled with the contents of the container, and unnecessary attraction of insects or other animals can be reduced.

The compacting motor 71 and its associated structure is particularly efficient in its operation, since the piston involves only a simple back and forth motion, and the structure utilizes a minimum number of moving parts. This reduces the problems of repair and contributes to the reliability of operation for the machine.

The anvil 81 is also designed to reduce the possibility of damage during operation, and to enhance the reliability of the device. Anvil 81 is attached to a support plate 86 by a series of six internal rods 87 and two guide support rods 89. The support rods 89 allow for anvil 81 to move horizontally toward support plate 86 under the impact of piston 20. Each of the interior rods 87 is surrounded by a spring 88 for urging anvil 81 and plate 86 apart. The support rods 89 are spaced apart, and extend through the support plate 86, the anvil 81, the piston 79 and the bracket 72. The rods 89 are fastened at opposite ends by nuts 76. As the shaft 73 rotates, eccentric 77 turns, thereby imparting a reciprocal motion to piston rod 75. Piston rod 75 is movably connected at the end opposite the motor 71 to a vertical pin 78. The pin 78 is fixed to a pair of mounts 90 which may be attached to piston 20 or integrally formed therewith. The motion of rod 75 causes piston 20 to slide back and forth on the support rods 89. Thus, the face plate 79 of piston 20 remains properly oriented for crushing the cans. Under the impact of piston 20 on a container, anvil 81 acts as both a crushing member and a shock absorber to reduce the possibility of damaging the compactor motor 71 or the other components of the crushing mechanism.

The apparatus also includes storage means for receiving crushed containers from the crushing means and for storing the crushed containers. As herein embodied, the storage means comprises a bag 72 positioned in the lower portion of the housing 10. As illustrated, the bag 72 has a drawstring 74 for facilitating mounting and removal of the bag from the apparatus. The bag 72 is accessible by opening the hinged front wall 12 of the housing 10. Alternatively, a separate disposal door (not shown) may be provided in the housing 10 for removing the bag 72.

An additional signal light 83 may be provided on the front of the housing 10 indicating when a received container is not acceptable. This signal light is connected to the sensing means by appropriate circuitry (not shown) and is responsive to the sensing means.

The sequence of operation of the apparatus of the present invention is initiated when an operator pushes the door 15 on the front of the housing 10, and inserts a container onto the shelf 16 in the container access area 22. The operator then allows the door 15 to close and pushes manual push-button 80 on the front wall 12 of the housing 10. Preferably, appropriate electrical circuitry and sensors (FIG. 7) are provided to verify at this point in the operation of the apparatus that the door 15 is closed. This same circuitry may be utilized to activate an optional signal light (not shown) on the front wall 12 of the apparatus to indicate that the door 15 is not fully closed. Activation of the manual push-button also energizes a solenoid (not shown) which operates a mechanism (not shown) for bolting the door 15 securely.

When the door 15 is securely bolted, an appropriate electrical switch (FIG. 7) is closed causing the preselection mechanism to be energized. The preselection mechanism then activates causing the container to be exposed to the aluminum detector 34 to determine if the composition of the container is substantially aluminum. If the container is determined to have an undesirable composition, the current to the preselection circuit cuts off, a signal light 83 is activated on the front wall 12 of the apparatus to indicate that the container is not acceptable, and the door 15 is automatically opened. The above sequence of operation will also take place if the manual push-button 80 is activated with no container present on the shelf 16. Preferably, appropriate sensing devices may be used in place of the manual pushbutton 80 to indicate the presence of a container on the shelf 16. In this configuration, the preselection means is energized automatically upon closing of the safety door 15.

If the indicator 37 shows that the composition of the container is aluminum, the motor 71 is started to cycle the piston 20 allowing the container to drop into the crushing area 69.

The coin-dispensing mechanism is also activated in response to an indication from the preselection means of the presence of a desired container. As the piston 20 cycles to crush the container, the coin dispenser ejects appropriate coins through the coin chute 64 to the slot 66. The coin dispenser may also be provided with circuitry to activate a signal light 38 on the front of the apparatus for indicating that the apparatus is full, or that no further coins are available for dispensing.

After ejection of the coins and operation of the crushing mechanism to compress the container, the apparatus shuts down and is ready for another container. Either immediately after crushing, or on the next crushing cycle, the crushed container falls by gravity into the bag 72. After crushing is complete, the automatic lock on the safety door 15 is then electrically released and the machine is ready to receive another container.

The apparatus is designed to operate on standard power supply and is preferably contained within an upright housing which is visually comparable in size to a soft drink dispensing machine.

The block functional diagram in FIG. 7 depicts one embodiment of a circuit for use in the apparatus of this invention. The sequence is initiated by the start block 92 which corresponds to activation of the push-button 80. A door open-closed sensor 94 then checks the status of the door 15. If the door is open, a door-open light 96 is activated. If the door is closed, the door lock 98 is energized and a door-locked sensor 100 initiates the current flow to the detector circuit (block 102). If the detector indicator 104 indicates that a container is aluminum, crusher 116 and coin and token dispensers 118 and 119 are activated. When the crusher 116 deactivates, the door 15 is automatically unlocked (122) and the start sequence is reset.

If an undesired composition is detected by the detector indicator 104, a bad can light is then activated as shown at block 124.

It will be apparent to those skilled in the art that various other electrical circuitry could be used without departing from the scope and spirit of the invention.

The apparatus may be provided with separate access ports to accommodate different sized containers or containers or different composition. In addition, the structure of the apparatus may be modified to allow reception of containers of different compositions, with a different token response for each container. In addition, modifications to crush and store the different containers in segregated storage locations could be made by those skilled in the art.

It will be apparent to those skilled in the art that various other modifications and variations could be made in the structure or method of the invention without departing from the scope and spirit of the invention.

What we claim is:

1. Apparatus for collecting and storing empty aluminum containers and for issuing predetermined return deposits for collected containers comprising:

preselection means for exposing a crushed or non-crushed container offered by a customer to an electromagnetic field for identifying whether said containers are substantially aluminum without establishing direct electrical contact with said container;

said preselection means including a container access area configured to accommodate both crushed or non-crushed containers for exposure to said field;

means for accepting only a container identified by said preselection means as being substantially aluminum, independent of the configuration of said container, including a horizontal shelf for receiving a said container directly from a customer and supporting said container in said container access area during operation of said preselection means;

coin-dispensing means responsive to said preselection means for dispensing coins in return for containers having a substantially aluminum composition;

means responsive to said accepting means for crushing said accepted containers, said crushing means including an anvil and a horizontally movable piston cooperating with said anvil for crushing said container between said anvil and said piston, said shelf being fixed to said piston for allowing said container to fall by gravity into the path of said piston and said anvil when said piston is activated; and means for storing crushed containers received from said crushing means.

2. The apparatus of claim 1 wherein the anvil is movably mounted in said machine under a bias for resiliently absorbing impact when said container is crushed between said anvil and said piston.

3. The apparatus of claim 2 also including weight override means for ordinarily supporting said container in the path of said anvil and said piston, said override means allowing said container to fall into said storage means without crushing when said container exceeds a predetermined weight.

4. The apparatus of claim 3 wherein said crushing means also includes a pair of support rods extending through each of said anvil and said piston for guiding the reciprocal movement of said piston, and for movably supporting said anvil.

5. The apparatus of claim 4 wherein said crushing means also includes a plurality of shock members, said shock members being attached to said anvil for absorbing impact when said container is crushed against said anvil.

6. The apparatus of claim 5 wherein said crushing means includes a motor having a drive shaft attached thereto, an eccentric member fixed to said drive shaft for rotation therewith, a piston rod movably attached to said eccentric member, and a piston operatively connected to said piston rod for reciprocally moving said piston in a horizontal plane under the action of said motor.

* * * * *